US005598587A

United States Patent [19]

Wada

[11] Patent Number: 5,598,587

[45] Date of Patent: Feb. 4, 1997

[54] MEN'S UNDERWEAR BRIEFS

[76] Inventor: Mikuni Wada, 911, Hirabari 3-chome, Tenpaku-ku, Nagoya-shi, Aichi-ken, Japan

[21] Appl. No.: 596,577

[22] Filed: Feb. 5, 1996

[30] Foreign Application Priority Data

Feb. 6, 1995 [JP] Japan ..... 7-001890 U

[51] Int. Cl.[6] ..... A41B 9/02

[52] U.S. Cl. ..... 2/403; 2/400

[58] Field of Search ..... 2/403, 400, 405; 602/69–74

[56] References Cited

U.S. PATENT DOCUMENTS

| | | | |
|---|---|---|---|
| 2,623,210 | 12/1952 | Chatfield | 2/403 |
| 2,872,685 | 2/1959 | Denbo | 2/403 |
| 3,166,764 | 1/1965 | Stedman et al. | 2/403 |
| 3,207,155 | 9/1965 | Casey | 2/403 |
| 3,283,545 | 11/1966 | Simon | 2/403 |
| 3,517,666 | 6/1970 | Atlee | 2/403 |
| 4,173,976 | 11/1979 | Bloomquist | 2/403 |
| 5,157,793 | 10/1992 | Michels | 2/403 |

*Primary Examiner*—Amy B. Vanatta
*Assistant Examiner*—Gloria Hale
*Attorney, Agent, or Firm*—Nikaido Marmelstein Murray & Oram LLP

[57] ABSTRACT

Briefs according to the invention can prevent contact between a pubic region and a thigh while there is a wide space to enclose the pubic region during the use. That is, the briefs according to the invention are provided with a small chamber (3) projecting from a small chamber entrance (2) at lower side of a brief body (1). The small chamber (3) can enclose sufficiently a pubic region comprising a testicle and a penis. Therefore a tight fit or a feeling of pushing does not exist although this is produced in underwear in the prior art. Also such state is prevented by a small chamber wall (5) around the small chamber (3) that a part of a testicle adheres closely to a thigh.

2 Claims, 6 Drawing Sheets

MEN'S UNDERWEAR BRIEFS

BACKGROUND OF THE INVENTION (1) Field of the Invention

The present invention relates to briefs for a man, which are not accompanied by pain or feeling of physical disorder during the use. Also it relates to briefs for a man, which can be used comfortably.

(2) Description of the Prior Art

There are briefs or trunks as underwear for a lower half of a body for a man in the prior art. However, these have defects as follows.

In briefs in the prior art in similar manner to underwear for a woman, there is insufficient space. Therefore during use, pubic hair, testicle and a penis are enclosed in a narrow space within the briefs while they are pushed toward the abdomen. This condition is liable to produce a feeling of physical disorder in the user. During the use of briefs in the prior art, since there is too little, it is difficult to move the location of a pubic region. Even if the location of the pubic region can be moved, the state is not changed that the pubic region is pushed and enclosed in the briefs. Therefore a feeling of physical disorder cannot be eliminated.

On the other hand, in trunks, the air draft is good during the use. However, during the use, a cuticle of a testicle is liable to adhere closely to the inside of a thigh. Therefore also during the use of trunks, there is feeling of physical disorder. In order to eliminate this feeling of physical disorder, during driving or in the presence of other people, it may be possible that while legs are opened the adhering is released or the location of the pubic region is changed. However, it is difficult to conduct such action during driving, because of interference with driving. Also it is difficult to conduct such action in the presence of other people, because of embarrassment.

Both in briefs and in trunks, during the use, such state may occur that a part of a testicle is caught in a gap between a thigh and a thigh passing hole 4. In this case, pain or feeling of physical disorder is liable to occur when a man sits down or during driving (refer to FIGS. 1 to 4).

For example, in briefs in the prior art, since the space to enclose the pubic region is narrow, use of slightly larger briefs may be considered. However, use of such slightly larger briefs is liable to be accompanied by the above-mentioned results.

Also during the use of trunks, a cuticle of a testicle may adhere closely to a thigh due to sweat or the like. Or during the use of trunks, in similar manner to briefs, a testicle may be held between a cloth material part enveloping the groin (root of legs) position of the trunks and a thigh. In such a case, the user is liable to be subjected to pain or feeling of physical disorder when he sits down or during driving.

Patience with such pain or feeling of physical disorder is not preferable because it causes disturbance of driving or of work.

SUMMARY OF THE INVENTION

In order to eliminate the defects in the prior art, an object of the present invention is to provide briefs for a man, which can be used comfortably without pain or feeling of physical disorder during the use.

The foregoing object can be attained by briefs capable of preventing contact between a pubic region and a thigh yet providing a wide space to enclose a pubic region during the use.

That is, briefs according to the present invention comprises a brief body 1, a small chamber entrance 2 at lower side of the brief body 1 and a small chamber 3 projecting from the small chamber entrance 2. In this small chamber 3, a pubic region comprising a testicle and a penis can be enclosed well. Therefore a tight fit or a feeling of pushing does not exist although this is produced in underwear in the prior art.

Also a small chamber wall 5 around the small chamber 3 prevents a part of a testicle from adhering closely to a thigh. As a result, a testicle is prevented from being caught between a thigh passing hole 4 and a thigh, which can be painful, and the briefs can be used comfortably.

Consequently, using the briefs of the present invention, comfortableness is felt during work or in the presence of other people and efficiency of study or labor can be improved.

DESCRIPTION OF THE PREFERRED EMBODIMENTS

Figure 1:
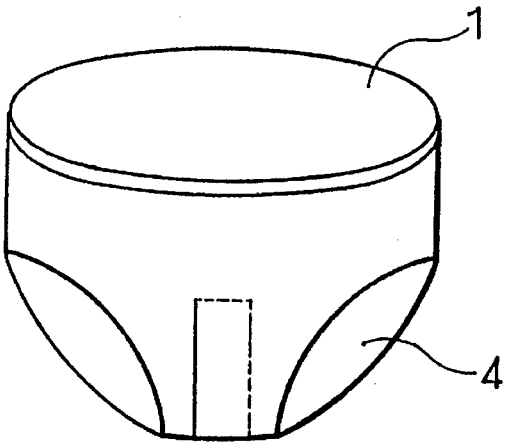
FIG. 1 is a front view showing briefs in the prior art.
Figure 2:
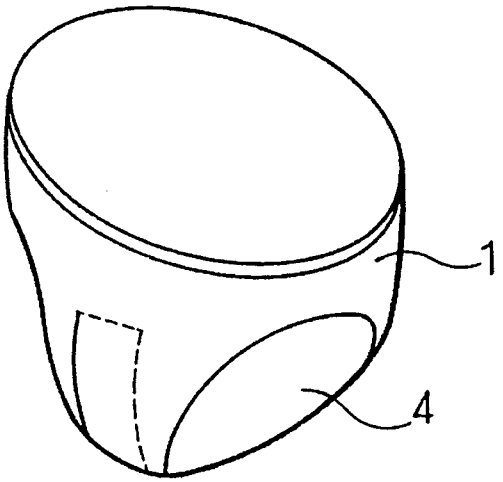
FIG. 2 is a perspective view showing briefs in the prior art.
Figure 3:
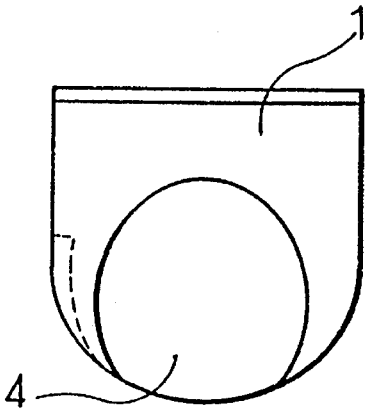
FIG. 3 is a side view showing briefs in the prior art.
Figure 4:
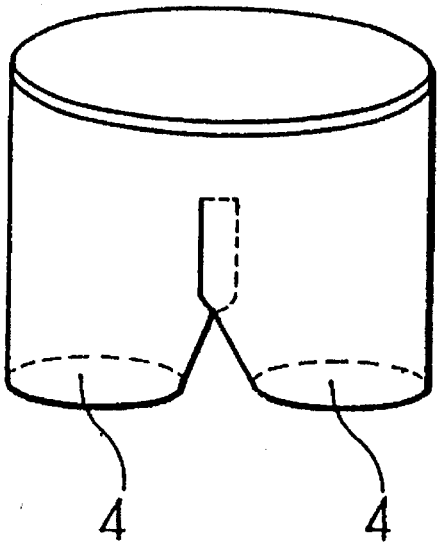
FIG. 4 is a front view showing trunks in the prior art.

The present invention will be described based on embodiments shown in the accompanying drawings as follows. In addition, the present invention is not limited to the embodiments shown in the drawings. All modifications within the requirements of the claims or equivalents thereof regarding these requirements are included within the scope of claims.

Figure 5:
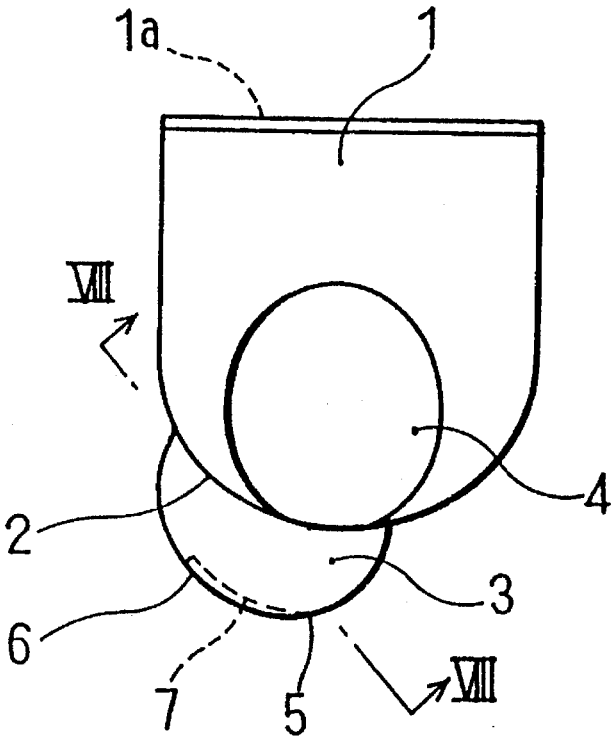
FIG. 5 is a side view of briefs showing an embodiment of the invention.
Figure 6:
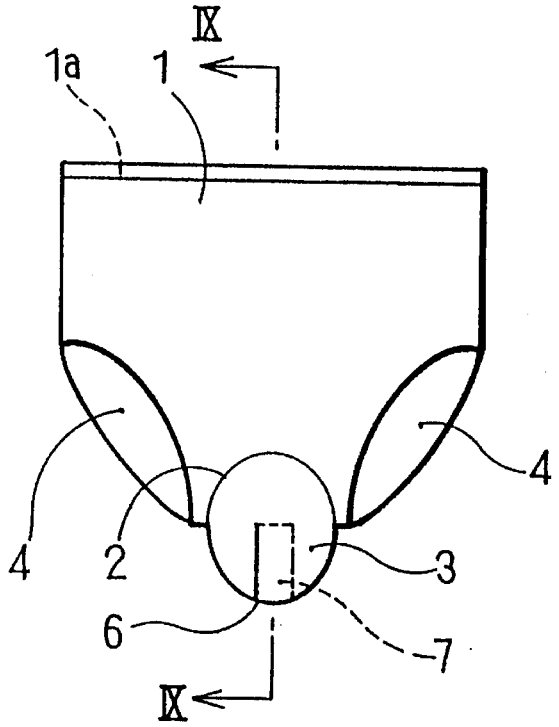
FIG. 6 is a front view of the briefs in the embodiment of FIG. 5.
Figure 7:
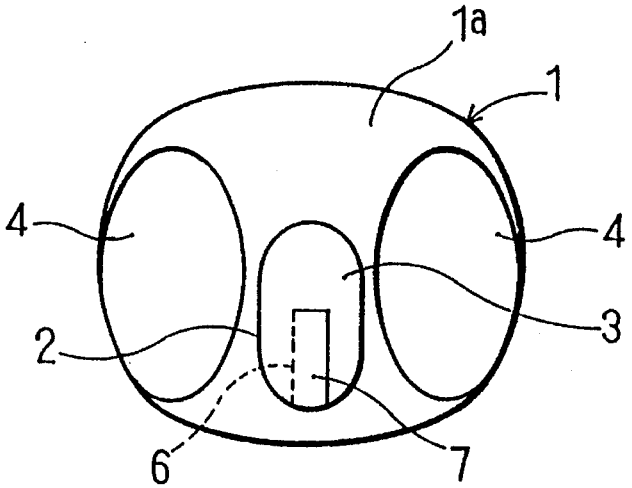
FIG. 7 is a plan view of the briefs in the embodiment of FIG. 5.

A pair of briefs in one embodiment of this invention are made of cloth material as shown in FIGS. 5 to 7 and provided with a bag-shaped body 1 and a bag-shaped small chamber 3.

The body 1 has a hole 1*a* in an upper side, through which a trunk passes and has two holes 4 through which thighs pass, respectively at a lower side.

The small chamber 3 is formed projecting from the lower front surface of the body 1 is surrounded by a wall 5. The small chamber 3 communicates with the body 1 through a small chamber entrance 2. The volume of the small chamber 3 is sufficient to enclose a pubic region. At a lower side of the front surface of the small chamber 3 is formed a through hole 6 to be used during urination. At the rear side of the small chamber 3, a cover cloth 7 is arranged on the periphery of the through hole 6. The cover cloth 7 is arranged so that the pubic region is not exposed when the through hole 6 is opened.

Figure 8:
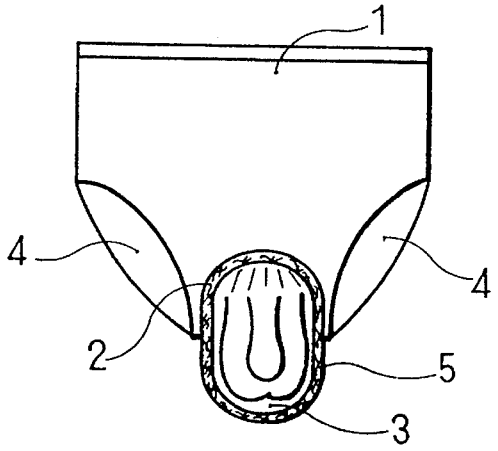
FIG. 8 is a front view of the embodiment of FIG. 5 with a partial section taken along line VIII—VIII of FIG. 5.
Figure 9:
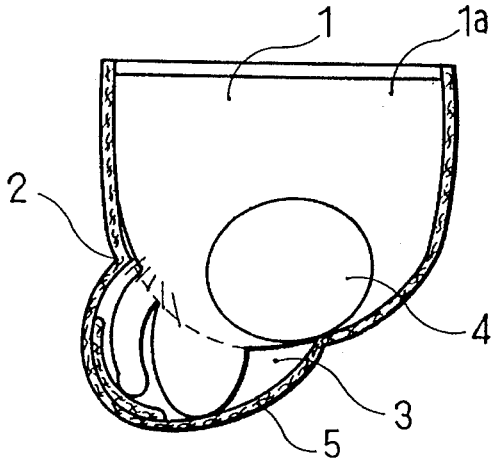
FIG. 9 is a sectional side view taken along line IX—IX of FIG. 6.
Figure 10:
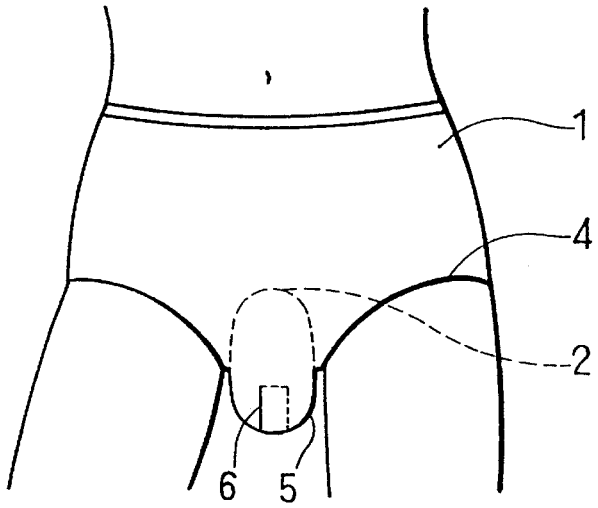
FIG. 10 is a front view showing the use state of the embodiment of FIG. 5.

The briefs of this embodiment are used in the state that the pubic region is enclosed within the small chamber 3 (refer to FIGS. 8 and 9).

During the use of the briefs, the pubic region is enclosed well within the small chamber 3. Also direct contact between a thigh and the pubic region is prevented by a small chamber wall 5.

Consequently, in the briefs of this embodiment, the pubic region can be enclosed well within the small chamber 3 and a man can be comfortably engaged in studies, labor or sports.

Also during use, since the contact between the pubic region and the thigh can be prevented, close adhering of these parts due to sweat or the like does not occur. Therefore during use, there is no feeling of physical disorder due to dermatitis, atopy or the like, but a quiet and comfortable feeling is produced.

Further, urination may be conducted using the through hole 6 at the top end of the small chamber wall 5.

Figure 11:
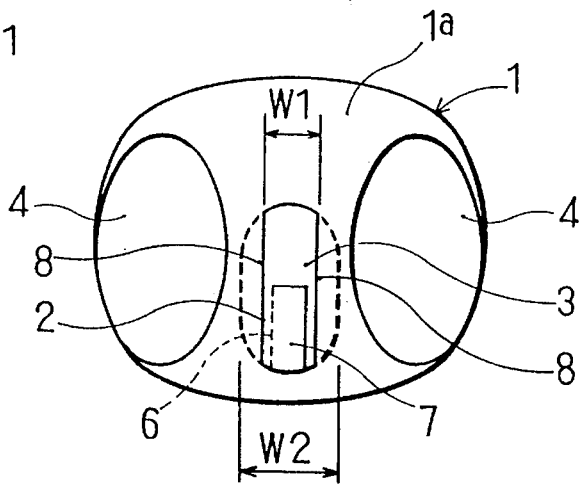
FIG. 11 is a plan view of another embodiment.
Figure 12:
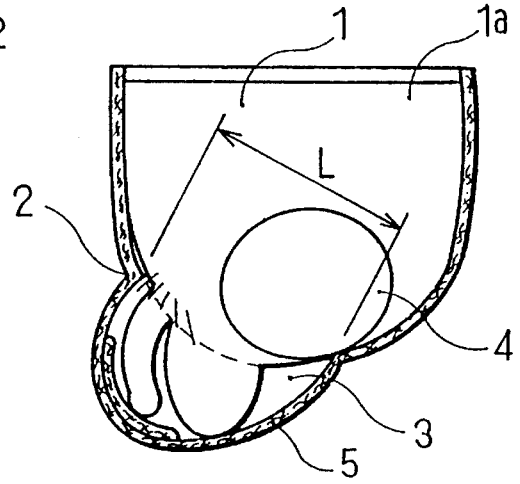
FIG. 12 is a sectional view showing the use state of the embodiment of FIG. 11.
Figure 13:
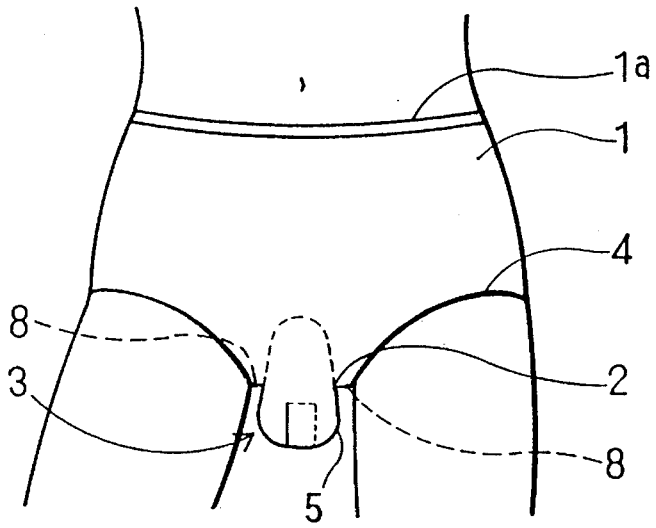
FIG. 13 is a front view showing the use state of the embodiment of FIG. 11.

In addition, as a modification of this embodiment, the configuration shown in FIGS. 11 to 13 may be done. The briefs in similar manner to the above-mentioned briefs are provided with a body 1 and a small chamber 3. However, a small chamber entrance 2 communicating with the body 1 and the small chamber 3 is formed as follows.

Lateral width W1 smaller than longitudinal width L is set smaller than lateral width W2 of the small chamber 3. Therefore the small chamber 3 when viewed from the front surface, is expanded into a pot-like shape. In addition, the volume of the small chamber 3 is made that so it can enclose the pubic region sufficiently.

In such briefs, during the use, a small chamber wall 5 is liable to come in to close contact with the pubic region. However, since the small chamber 3 has a sufficient volume to enclose the pubic region, the close contacting not strongly push that the pubic region.

Therefore during the use, such wearing sense can be obtained that the pubic region is enveloped softly, and further comfortable feeling is obtained.

Also the briefs are made of cloth material. Therefore even if the lateral width W1 of the small chamber entrance 2 is narrow, the small chamber entrance 2 is opened at the wearing state and the pubic region can be easily enclosed in the small chamber 3. During wearing, cloth material portions 8, 8 in both lateral edges of the small chamber entrance 2 gently push both sides of the pubic region at its root. Therefore in the briefs, a finger-pressure treatment is accomplished at the root of the pubic region.

Figure 14:
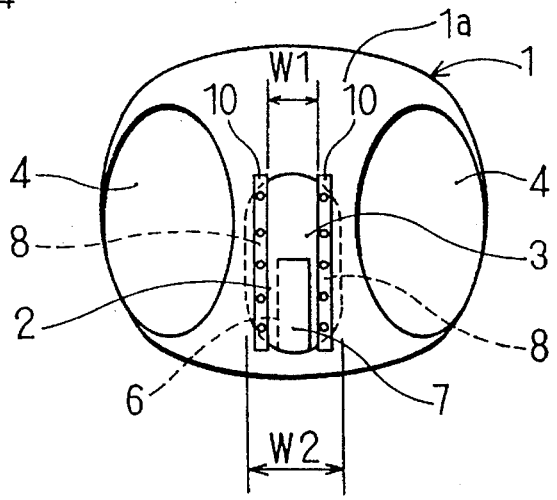
FIG. 14 is a plan view of another embodiment.
Figure 15:
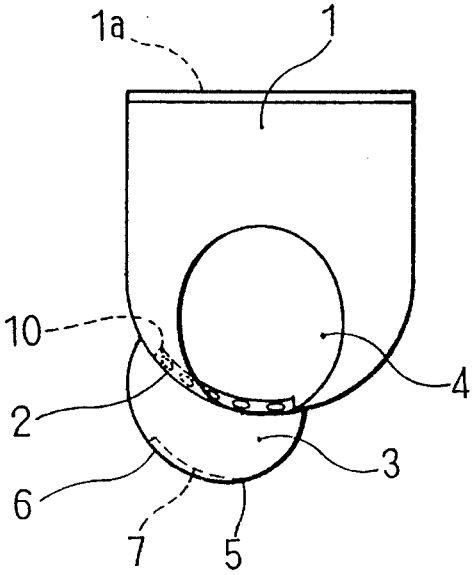
FIG. 15 is a side view of the embodiment of FIG. 14.

Further as a modification of the embodiment shown in FIG. 11, a configuration as shown in FIGS. 14 and 15 may be done. The briefs, in similar manner to the above-mentioned briefs, are provided with a body 1 and a small chamber 3. However, a magnet belt 10 is sewn respectively on both lateral edges of the small chamber entrance 2 in the body 1.

Figure 16:
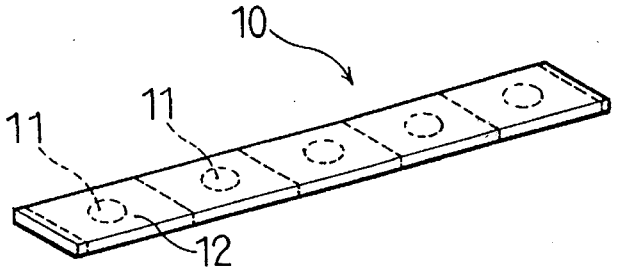
FIG. 16 is a perspective view showing a magnet belt used in the embodiment of FIGS. 14 and 15.

The magnet belt 10 as shown in FIG. 16 is constituted by that a plurality of permanent magnets 11 which are enveloped by a cloth material 12. Each magnet 11 is formed as a small disk having a diameter of 6 mm and a thickness of 1.5 mm. The cloth material 12 is formed as a flat cylinder having a lateral width of 1 cm and a length of 16 cm. Fixing of the magnets 11 is accomplished such that about five magnets are enclosed in the cloth material 12 and the sewing is conducted at the front side and the rear side of each magnet 11.

If the briefs are worn, the circulation of the blood in the human body can be improved by the action of the magnetic force of the permanent magnets 11. Also both sides of the pubic region in the root can be pushed weakly by the cloth material portions 8, 8 and the magnet belts 10, 10. Therefore also in the briefs, the finger-pressure treatment can be conducted at the root of the pubic region.

What is claimed is:

1. Briefs for a human man comprising:

a bag shaped body comprising an upper side, a lower side and a front surface; said bag shaped body having a hole in said upper side for passing a trunk of a human man's body therethrough and two holes in said lower side for passing two thighs of said human man's body, respectively, therethrough;

a small chamber, having a volume sufficient to enclose a pubic region of said human man's body communicating with said bag shaped body through an aperture in said front surface directed to toward said lower side, said small chamber projecting from the lower front surface of said body and being surrounded by a wall, said small chamber further comprising lateral edges proximate to said aperture, and a plurality of permanent magnets enveloped in strips of cloth material sewn, respectively, on said lateral edges of said small chamber.

2. Briefs as set forth in claim 1 further comprising a through hole for urination formed on the front surface of said small chamber.

* * * * *